US012292222B2

(12) United States Patent
Cui et al.

(10) Patent No.: US 12,292,222 B2
(45) Date of Patent: May 6, 2025

(54) REFRIGERATOR AND CONTROL METHOD THEREFOR

(71) Applicants: CHONGQING HAIER REFRIGERATION ELECTRIC APPLIANCE CO., LTD., Chongqing (CN); QINGDAO HAIER REFRIGERATOR CO., LTD., Shandong (CN); HAIER SMART HOME CO., LTD., Shandong (CN)

(72) Inventors: Zhanpeng Cui, Shandong (CN); Jiaming Li, Shandong (CN); Peng Lyu, Shandong (CN); Lisheng Ji, Shandong (CN)

(73) Assignees: CHONGQING HAIER REFRIGERATION ELECTRIC APPLIANCE CO., LTD., Chongqing (CN); QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 173 days.

(21) Appl. No.: 18/025,274

(22) PCT Filed: Aug. 31, 2021

(86) PCT No.: PCT/CN2021/115636
§ 371 (c)(1),
(2) Date: Mar. 8, 2023

(87) PCT Pub. No.: WO2022/057614
PCT Pub. Date: Mar. 24, 2022

(65) Prior Publication Data

US 2023/0324100 A1 Oct. 12, 2023

(30) Foreign Application Priority Data

Sep. 15, 2020 (CN) ..... 202010969233.8

(51) Int. Cl.
*F25D 17/06* (2006.01)

(52) U.S. Cl.
CPC ..... *F25D 17/062* (2013.01)

(58) Field of Classification Search
CPC ..... F25D 17/062; F25D 23/02; F25D 29/005; F25D 29/00; F25D 2317/062;
(Continued)

(56) References Cited

U.S. PATENT DOCUMENTS

2017/0234603 A1 8/2017 Basso

FOREIGN PATENT DOCUMENTS

CN 104457102 A 3/2015
CN 105222505 A * 1/2016 ..... F25D 29/00
(Continued)

OTHER PUBLICATIONS

Chinese Intellectual Property Office (ISR/CN), "International Search Report for PCT/CN2021/115636", China, Nov. 24, 2021.
(Continued)

*Primary Examiner* — Emmanuel E Duke
(74) *Attorney, Agent, or Firm* — troutman pepper locke; Tim Tingkang Xia, Esq.

(57) ABSTRACT

A refrigerator and a control method therefor are provided. The refrigerator comprises a refrigerator body defining a first chamber, and a door body that comprises a main door defining a second chamber, and a secondary door; and the rear side of the main door is provided with an air supply port for introducing cold air in the first chamber into the second chamber. The control method comprises: acquiring an absolute air humidity $\rho_1$ of the first chamber and an air temperature $T_2$ of the second chamber; calculating an expected relative humidity $\varphi_3$ of air in the first chamber when the temperature changes to $T_2$ according to $\rho_1$ and $T_2$; determining a relative air humidity critical value $\varphi_0$; comparing
(Continued)

$\varphi_3$ with $\varphi_0$; and if $\varphi_3<\varphi_0$, making the air supply port supply air to the second chamber, otherwise, making the air supply port stop supplying air to the second chamber.

10 Claims, 4 Drawing Sheets

(58) Field of Classification Search
CPC ..... F25D 2323/023; F25D 2700/121; F25D 21/04; F25D 11/00; F25D 2700/12
See application file for complete search history.

(56) References Cited

FOREIGN PATENT DOCUMENTS

| | | | | | |
|---|---|---|---|---|---|
| CN | 105444489 | A | * | 3/2016 | |
| CN | 105526770 | A | * | 4/2016 | ..... F25D 11/02 |
| CN | 105806010 | A | * | 7/2016 | ..... F25D 11/02 |
| CN | 108050745 | A | | 5/2018 | |
| CN | 108106298 | A | | 6/2018 | |
| CN | 108917271 | A | | 11/2018 | |
| CN | 105222505 | B | * | 9/2019 | ..... F25D 29/00 |
| CN | 110513957 | A | * | 11/2019 | ..... F25D 21/04 |
| KR | 950014811 | A | | 6/1995 | |
| KR | 20160045316 | A | * | 4/2016 | ..... F25D 17/08 |

OTHER PUBLICATIONS

EPO, "Supplementary European Search Report for EP Application No. 21868441.3", Hague, Germany, Dec. 4, 2023.

* cited by examiner

REFRIGERATOR AND CONTROL METHOD THEREFOR

CROSS-REFERENCE TO RELATED PATENT APPLICATION

This application is a U.S. national stage application of PCT Patent Application No. PCT/CN2021/115636 filed Aug. 31, 2021, which claims priority to and the benefit of Chinese Application No. 202010969233.8 filed Sep. 15, 2020, which are incorporated herein in their entireties by reference.

FIELD OF THE INVENTION

The present invention relates to the technical field of refrigeration and freezing, and in particular to a refrigerator and a control method therefor.

BACKGROUND OF THE INVENTION

With the development of technologies and the improvement of people's living standards, users have higher and higher requirements on refrigerators. A conventional refrigerator provided with only a refrigeration chamber, a freezing chamber and a variable-temperature chamber can no longer meet the diversified needs of users on storage spaces.

In recent years, a composite door technology has emerged in the field of refrigerators. It is known to all that a conventional refrigerator door body is used to open or close a refrigerating chamber of a refrigerator body, and at most a bottle holder for placing bottled products is disposed at a lining of a refrigeration door body. However, a refrigerator with a composite door body is improved in structure and function of the door body, where the door body includes a main door and a secondary door, and the main door is used to open or close the refrigerating chamber. In addition, the main door defines a door chamber with an open front side, and the secondary door is used to open or close the door chamber. During rotation of the main door, the secondary door is kept closed. The door chamber may be used to place to-be-stored objects, and a user just needs to open the secondary door to take or put objects without opening the main door. This achieves more convenient and more efficient operation, and also avoids excessive loss of cold energy caused by frequent opening of the main door.

However, in an operating process of a composite door type refrigerator, frequent occurrence of condensation on the inner wall of the door chamber affects user experience and hinders further development of the composite door technology. Therefore, how to reduce or avoid condensation on the inner wall of the door chamber has become a technical problem to be solved urgently in the art.

BRIEF DESCRIPTION OF THE INVENTION

The present invention aims to provide a refrigerator and a control method for the refrigerator to at least overcome one of the above shortcomings existing in the prior art.

The present invention aims to reduce or avoid condensation on an inner wall of a door chamber.

The present invention further aims to avoid adverse effects of temperature and humidity fluctuation in a refrigerator body chamber on a temperature and a humidity in the door chamber.

In one aspect, the present invention provides a control method for a refrigerator. The refrigerator includes a refrigerator body having a front side opened to define a first chamber, and a door body configured to open or close the first chamber; the door body includes a main door and a secondary door, where the main door is configured to open or close the first chamber and defines a second chamber, the secondary door is configured to open or close the second chamber, and a rear side of the main door is provided with an air supply port configured to introduce cold air in the first chamber into the second chamber; and the control method includes:

acquiring an absolute air humidity $\rho_1$ of the first chamber and an air temperature $T_2$ of the second chamber;

calculating an expected relative humidity $\varphi_3$ of air in the first chamber when the temperature changes to $T_2$ based on the absolute air humidity $\rho_1$ and the air temperature $T_2$;

determining a relative air humidity threshold $\varphi_0$ at which air in the second chamber begins to condense on an inner wall of the second chamber;

comparing the expected relative humidity $\varphi_3$ with the relative air humidity threshold $\varphi_0$; and if $\varphi_3<\varphi_0$, enabling the air supply port to supply air to the second chamber, otherwise enabling the air supply port to stop supplying air to the second chamber.

Optionally, the control method further includes:

acquiring a temperature $T_3$ of the inner wall of the second chamber; and calculating the relative air humidity threshold $\varphi_0$ based on a correspondence relationship of a dew-point temperature, an ambient temperature and a relative humidity by taking the temperature $T_3$ of the inner wall as the dew-point temperature and the air temperature $T_2$ as the ambient temperature.

Optionally, the step of acquiring a temperature $T_3$ of the inner wall of the second chamber includes: detecting a temperature of a rear wall of the second chamber, and taking the temperature as the temperature $T_3$ of the inner wall.

Optionally, a distance from a temperature detection point on the rear wall of the second chamber to the air supply port is shorter than or equal to a first preset distance.

Optionally, a distance from a detection point of the air temperature $T_2$ to the air supply port is shorter than or equal to a second preset distance.

Optionally, the control method further includes:

detecting an air temperature $T_1$ in the first chamber and a relative air humidity $\varphi_1$ in the first chamber; and calculating the absolute air humidity $\rho_1$ based on the air temperature $T_1$ and the relative air humidity $\varphi_1$.

Optionally, distances from a detection point of the air temperature $T_1$ and a detection point of the relative air humidity $\varphi_1$ to the air supply port are shorter than or equal to a third preset distance.

Optionally, a fan is mounted at the air supply port; and in the control method, the step of if $\varphi_3<\varphi_0$, enabling the air supply port to supply air to the second chamber, otherwise enabling the air supply port to stop supplying air to the second chamber includes:

if $\varphi_3<\varphi_0$, turning on the fan to enable the air supply port to supply air to the second chamber, otherwise turning off the fan to enable the air supply port to stop supplying air to the second chamber.

In another aspect, the present invention further provides a refrigerator, including:

a refrigerator body, with a front side opened to define a first chamber; and a door body, including a main door and a secondary door, where the main door is configured to open or close the first chamber and defines a second chamber, the secondary door is configured to open or close the second chamber, and a rear side of the main door is provided with an air supply port configured to introduce cold air in the first chamber into the second chamber; and a controller, including a processor and a memory, where the memory stores a computer program, and when the computer program is executed by the processor, the control method according to any one of the above descriptions is implemented.

Optionally, the first chamber is a refrigeration chamber; the air supply port is disposed at the top of a rear side of the main door; and the bottom of the rear side of the main door is further provided with an air return port for enabling air in the second chamber to flow to the first chamber.

The refrigerator and the control method therefor provided by the present invention, to a certain extent, solve the problem that condensation easily occurs on the inner wall of the second chamber defined by the door body in a composite door type refrigerator. Specifically, the inventors have realized that one significant reason for probable occurrence of condensation on the inner wall of the second chamber is that high-humidity air is introduced from the first chamber of the refrigerator body. Especially when the first chamber is just opened or closed, external air with relatively high humidity and temperature enters the first chamber, and if the air subsequently enters the second chamber, it is easy to produce condensation on the inner wall of the second chamber. Therefore, according to the present invention, before cold air in the first chamber is introduced into the second chamber, the expected relative humidity $\varphi_3$ of the air in the first chamber when the temperature changes to the air temperature $T_2$ in the second chamber, and the relative air humidity threshold $\varphi_0$ at which the air begins to condense on the inner wall of the second chamber (when the relative humidity of the air around the inner wall of the second chamber is higher than the relative air humidity threshold $\varphi_0$, condensation will be absolutely produced on the inner wall) are calculated first and are compared; only when $\varphi_3<\varphi_0$, the air supply port is enabled to supply air to the second chamber; otherwise, the air support port is enabled to stop supplying air to the second chamber, thereby avoiding the problem of production of condensation on the inner wall of the second chamber caused by introduction of the cold air from the first chamber to the second chamber immediately after the first chamber is just opened or closed or after other operations that cause increase of the air humidity in the first chamber. In addition, according to the present invention, the external high-humidity and high-temperature air can be prevented from entering the second chamber after the first chamber is opened or closed, so that adverse effects of temperature fluctuation in the first chamber on a temperature and a humidity in the second chamber are prevented as well. In this way, the temperature and humidity of the air in the second chamber are kept at a reasonable level.

In particular, according to the present invention, before the air in the first chamber enters the second chamber, the expected relative humidity $\varphi_3$ of the air in the first chamber when the temperature changes to $T_2$ after the air enters the second chamber is predicted based on the absolute air humidity $\rho_1$ in the first chamber and the air temperature $T_2$, so as to determine whether condensation will be produced on the inner wall of the second chamber after the air enters the first chamber. Such calculation manner ingeniously realizes prediction on a condensation condition and avoids production of condensation.

Further, in the refrigerator and the control method therefor provided by the present invention, the distances from the detection point of the air temperature $T_1$ in the first chamber, the detection point of the relative air humidity $\varphi_1$ in the first chamber, the temperature detection point on the rear wall of the second chamber, and the detection point of the air temperature $T_2$ of the second chamber to the air supply port are limited to make sure that the above detection points are closer to the air supply port, so that temperature and humidity detection is specially performed on an air flow that first enters the air supply port in a later period, thereby achieving more accurate prediction on whether condensation will be produced after the air flow in the first chamber flows into the second chamber.

Persons skilled in the art can more clearly understand the above and other purposes, advantages and features of the present invention according to detailed description of specific embodiments of the present invention with reference to the accompanying drawings.

BRIEF DESCRIPTION OF THE DRAWINGS

Some specific embodiments of the present invention are described below in detail in an exemplary and unlimited way with reference to the accompanying drawings. The same or similar components or parts are indicated by the same reference numerals in the drawings. Persons skilled in the art should understand that these drawings are not necessarily drawn to scale. In the drawings.

DETAILED DESCRIPTION

Figure 1:
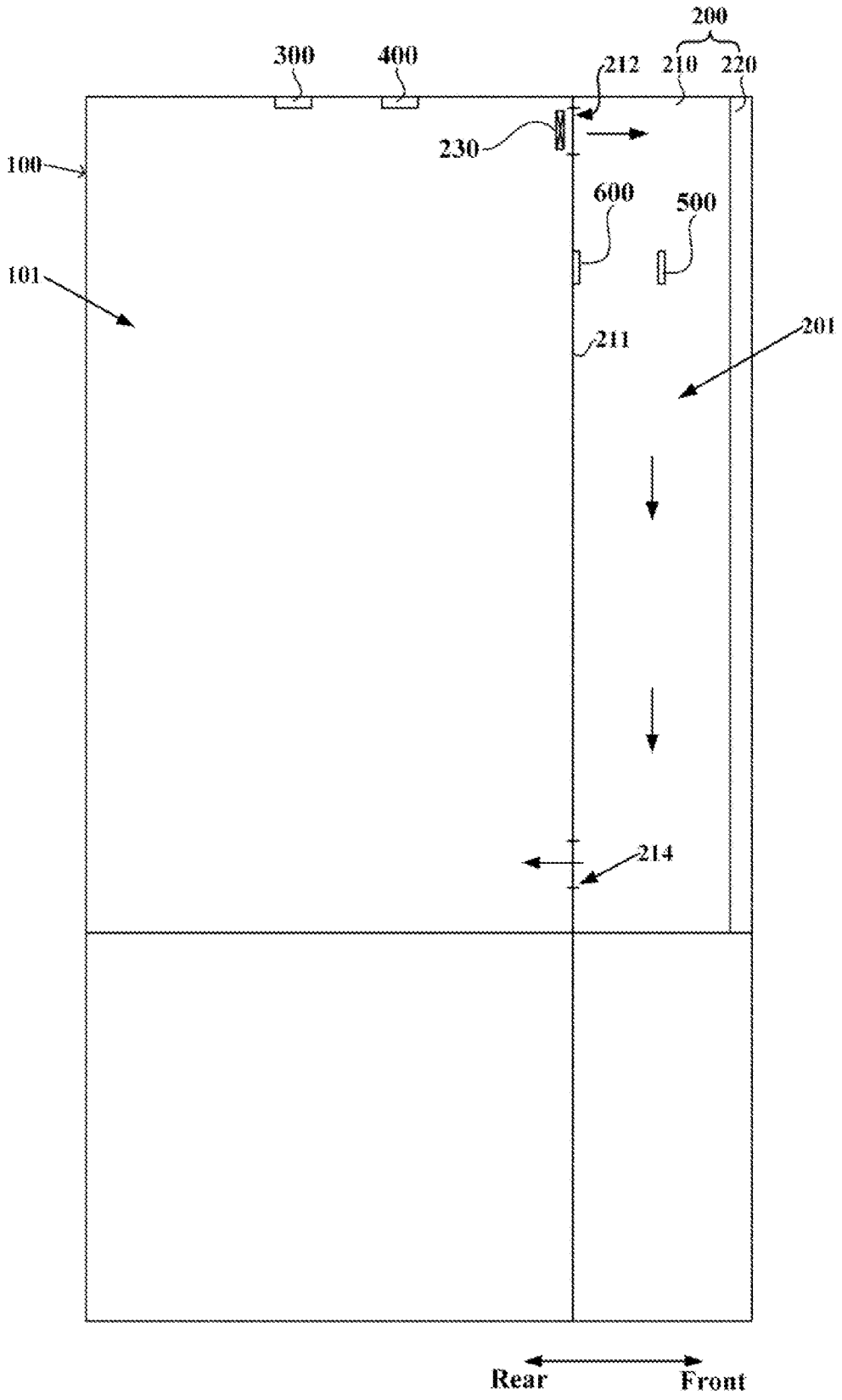
FIG. 1 is a schematic structural diagram of a refrigerator according to an embodiment of the present invention.
Figure 2:
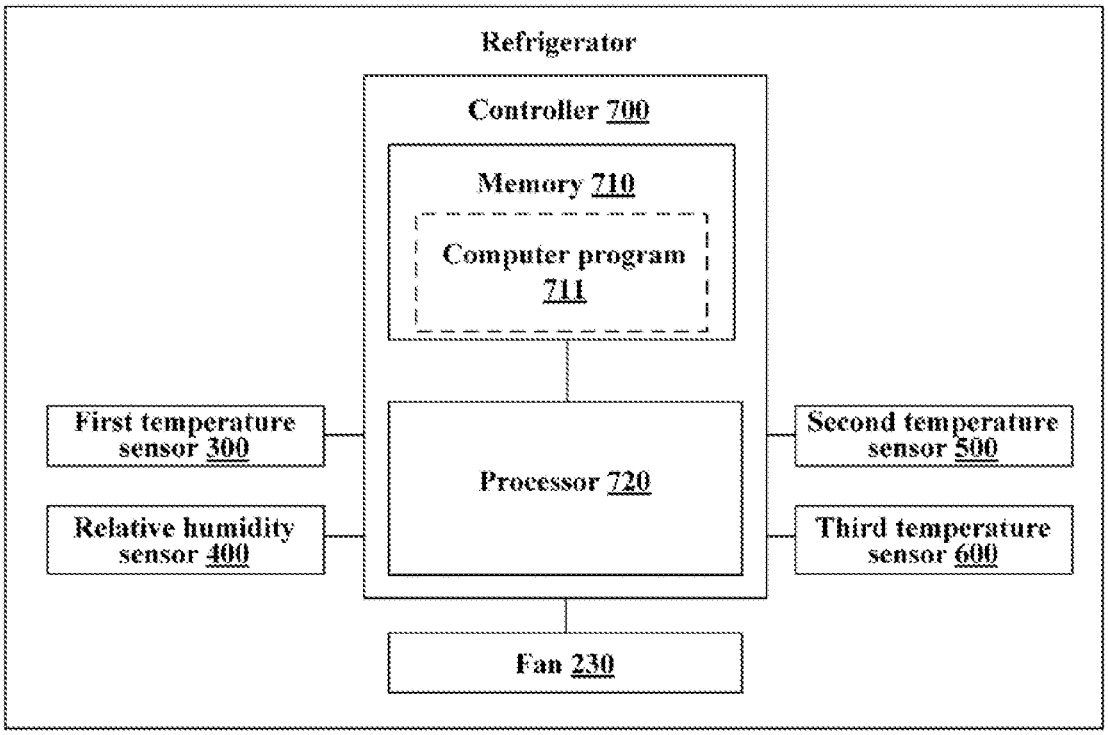
FIG. 2 is a schematic block diagram of a refrigerator according to an embodiment of the present invention.

FIG. 1 is a schematic structural diagram of a refrigerator according to an embodiment of the present invention. FIG. 2 is a schematic block diagram of a refrigerator according to an embodiment of the present invention.

An embodiment of the present invention provides a control method for a refrigerator. As shown in FIG. 1 and FIG. 2, the refrigerator includes a refrigerator body 100, a door body 200 and a controller 700.

A front side of the refrigerator body 100 is opened to define a first chamber 101. The door body 200 includes a main door 210 and a secondary door 220, where the main door 210 is configured to open or close the first chamber 101 and defines a second chamber 201, the secondary door 220 is configured to open or close the second chamber 201, and a rear side of the main door 210 is provided with an air supply port 212 configured to introduce cold air in the first chamber 101 into the second chamber 201. After cold air enters the second chamber 201, the second chamber 201 is refrigerated. The main door 210 may be rotatably mounted on the refrigerator body 100 at the front side of the refrigerator body 100; and a front side of the main door 210 is opened to define the second chamber 201, and the secondary door 220 is rotatably mounted on the main door 210 at the front side of the main door 210. When the main door 210 is opened, a user stores or gets objects in the first chamber 101. When the main door 210 is closed and the secondary door 220 is opened, a user can store or get objects in the second chamber 201. The controller 700 includes a processor 720 and a memory 710, where the memory 710 stores a computer program 711, and when the computer program 711 is executed by the processor 720, the control method for a refrigerator according to this embodiment is implemented.

The refrigerator can perform refrigeration through a vapor compression refrigeration circulation system, a semiconductor refrigeration system, or other ways. According to differences of refrigeration temperatures, the chambers inside the refrigerator may be classified into a refrigeration chamber, a freezing chamber and a variable-temperature chamber. For example, a temperature in the refrigeration chamber is generally controlled between 2° C. and 10° C., preferably between 4° C. and 7° C. A temperature in the freezing chamber is generally controlled between −22° C. and −14° C. A temperature in the variable-temperature chamber may be adjusted between −18° C. and 8° C. so as to realize a temperature variation effect. Different types of objects should be stored at different optimal storage temperatures, and also should be stored in different storage chambers. For example, fruit and vegetable foods are suitable for being stored in a refrigeration chamber, while meat foods are suitable for being stored in a freezing chamber.

In some embodiments, the first chamber 101 is a refrigeration chamber. In addition, the air supply port 212 may be disposed at the top of the rear side of the main door 210, and the bottom of the rear side of the main door 210 is further provided with an air return port 214 for enabling air in the second chamber 201 to flow to the first chamber 101. After flowing from the air supply port 212 into the second chamber 201, cold air, due to its relatively large density, sinks and flows down to sequentially refrigerate regions at all heights of the second chamber 201, and the air flows back to the first chamber 101 via the air return port 214 at the bottom of the second chamber 201 after the temperature of the air rises gradually. In this way, smoother air path circulation is formed, which improves a refrigeration effect of the second chamber 201. It can be understood that air returning can be implemented by the air supply port 212 if no air return port 214 is provided.

Figure 3:
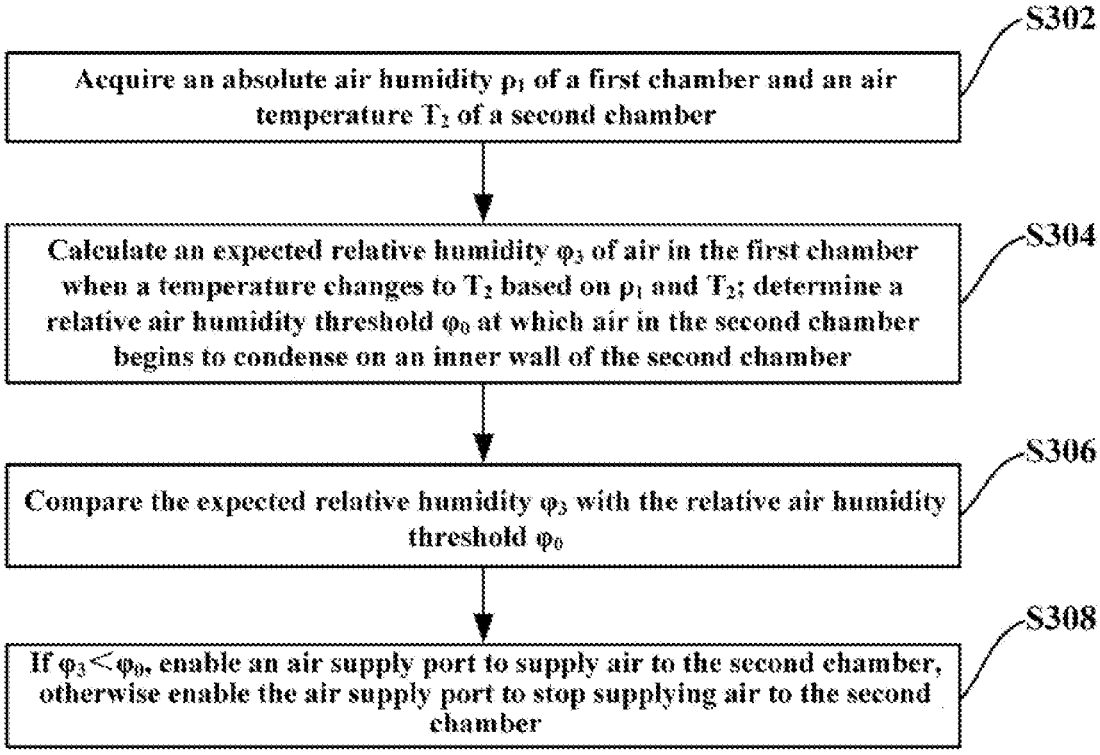
FIG. 3 is a schematic diagram of a control method for a refrigerator according to an embodiment of the present invention.

FIG. 3 is a schematic diagram of a control method for a refrigerator according to an embodiment of the present invention. The control method for a refrigerator according to this embodiment of the present invention is applicable to the refrigerators according to all the foregoing embodiments of the present invention. As shown in FIG. 3, the control method for a refrigerator includes:

Step S302: acquiring an absolute air humidity $\rho_1$ of the first chamber 101 and an air temperature $T_2$ of the second chamber 201.

In step S302, the absolute air humidity $\rho_1$ of the first chamber 101 may be directly measured. However, the absolute air humidity $\rho_1$ is preferably indirectly obtained through calculation, so that a more accurate result can be obtained. Specifically, an air temperature $T_1$ in the first chamber 101 and a relative air humidity $\varphi_1$ in the first chamber 101 are detected first, and the absolute air humidity pi is calculated based on the air temperature $T_1$ and the relative air humidity $\varphi_1$.

Step S304: calculating an expected relative humidity $\varphi_3$ of air in the first chamber 101 when the temperature changes to $T_2$ based on the absolute air humidity $\rho_1$ and the air temperature $T_2$. In addition, a relative air humidity threshold $\varphi_0$ at which air in the second chamber 201 begins to condense on an inner wall of the second chamber 201 is determined.

It can be learned by persons skilled in the art that an absolute humidity of moist air (air containing vapor) refers to a mass of vapor contained in unit volume of moist air. Under a specified air pressure and a specified temperature, the vapor in unit volume of air has an upper limit. If the vapor in this volume of air exceeds the upper limit, that is, a maximum absolute humidity is reached, vapor condensation may occur. A relative humidity of moist air refers to a ratio of an absolute humidity of the moist air at a specified temperature to a reachable maximum absolute humidity of the moist air at the same temperature, and the ratio is a percentage. With a higher temperature, air can contain more vapor. Therefore, when an absolute humidity of moist air is unchanged, a relative humidity of the moist air will change dependent on temperature.

Accordingly, in step S304, the expected relative humidity $\varphi_3$ refers to a final relative humidity of an input air flow with an absolute humidity $\rho_1$ in the first chamber 101 as the temperature changes to be the same as the air temperature (namely $T_2$) in the second chamber (201) when the input air flow exchanges heat with the air in the second chamber 201 after entering the second chamber 201. A relative humidity threshold refers to a minimum relative humidity at which condensation is produced by the air on the inner wall of the second chamber 201 when the air temperature is $T_2$, that is, a maximum relative humidity that enables the inner wall of the second chamber 201 to be kept with no condensation. When a relative humidity of the air around the inner wall of the second chamber 201 is higher than the relative air humidity threshold $\varphi_0$, condensation may be produced on the inner wall.

Step S306: comparing the expected relative humidity $\varphi_3$ with the relative air humidity threshold $\varphi_0$.

Step S308: If $\varphi_3<\varphi_0$, enabling the air supply port 212 to supply air to the second chamber 201, otherwise enabling the air supply port 212 to stop supplying air to the second chamber 201.

Preferably, a fan 230 is mounted at the air supply port 212. In step S308, if $\varphi_3<\varphi_0$, the fan 230 is turned on to enable the air supply port 212 to supply air to the second chamber 201, otherwise the fan is turned off to enable the air supply port 212 to stop supplying air to the second chamber 201. In some alternative embodiments, a damper may be disposed at the air supply port 212, and the damper is controlled to open or close so as to start or stop air supply to the second chamber 201. Alternatively, the fan 230 and the damper are both provided, and the fan 230 and the damper are controlled to open or close simultaneously, so as to realize more accurate control on an air supply state of the air supply port 212.

The above steps in this embodiment of the present invention are cyclically implemented. In other words, after the air supply port 212 is opened for air supply or stops air supply, step S302 to step S308 need to be implemented again, so that an open/close state of the air supply port 212 can be adjusted as soon as possible based on temperature and humidity changes of the first chamber 101 and the second chamber 201.

The control method in this embodiment of the present invention, to a certain extent, solves the problem that condensation easily occurs on the inner wall of the second chamber 201 defined by the door body 200 in a composite door type refrigerator. Specifically, the inventors have realized that a significant reason for probable occurrence of condensation on the inner wall of the second chamber 201 is that high-humidity air is introduced from the first chamber 101 of the refrigerator body 100. Especially when the first chamber 101 is just opened or closed, external air with relatively high humidity and temperature enters the first chamber 101, and if the air subsequently enters the second chamber 201, it is easier to produce condensation on the inner wall of the second chamber 201. Therefore, according to the present invention, before cold air in the first chamber 101 is introduced into the second chamber 201, the expected relative humidity $\varphi_3$ of the air in the first chamber 101 when the temperature changes to the air temperature $T_2$ in the second chamber 201, and the relative air humidity threshold $\varphi_0$ at which the air begins to condense on the inner wall of the second chamber 201 are calculated first and are compared; only when $\varphi_3<\varphi_0$, the air supply port 212 is enabled to supply air to the second chamber 201; otherwise, the air support port 212 is enabled to stop supplying air to the second chamber 201, thereby avoiding the problem of production of condensation on the inner wall of the second chamber 201 caused by introduction of the cold air from the first chamber 101 to the second chamber 201 immediately after the first chamber 101 is just opened or closed or after other operations that cause increase of the air humidity in the first chamber 101. According to the present invention, the external high-humidity and high-temperature air can be prevented from entering the second chamber 201 after the first chamber 101 is opened or closed, so that adverse effects of temperature fluctuation in the first chamber 101 on a temperature and a humidity in the second chamber 201 are prevented as well. In this way, the temperature and humidity of the air in the second chamber 201 are kept at a reasonable level.

In particular, in this embodiment of the present invention, before the air in the first chamber 101 enters the second chamber 201, the expected relative humidity $\varphi_3$ of the air in the first chamber 101 when the temperature changes to $T_2$ after the air enters the second chamber 201 is predicted based on the absolute air humidity $\rho_1$ in the first chamber 101 and the air temperature $T_2$, so as to determine whether condensation will be produced on the inner wall of the second chamber 201 after the air enters the first chamber 101. Such calculation manner ingeniously realizes prediction on a condensation condition and avoids production of condensation.

In some optional embodiments, the forgoing steps may be further optimized and configured to make the refrigerator achieve better technical effects. The following describes in detail the control method for a refrigerator according to this embodiment in conjunction with introduction of an optional execution procedure of this embodiment. This embodiment is merely an example of the execution procedure. In specific implementation, the execution sequence and operation conditions of some steps may be modified according to specific implementation requirements.

Figure 4:
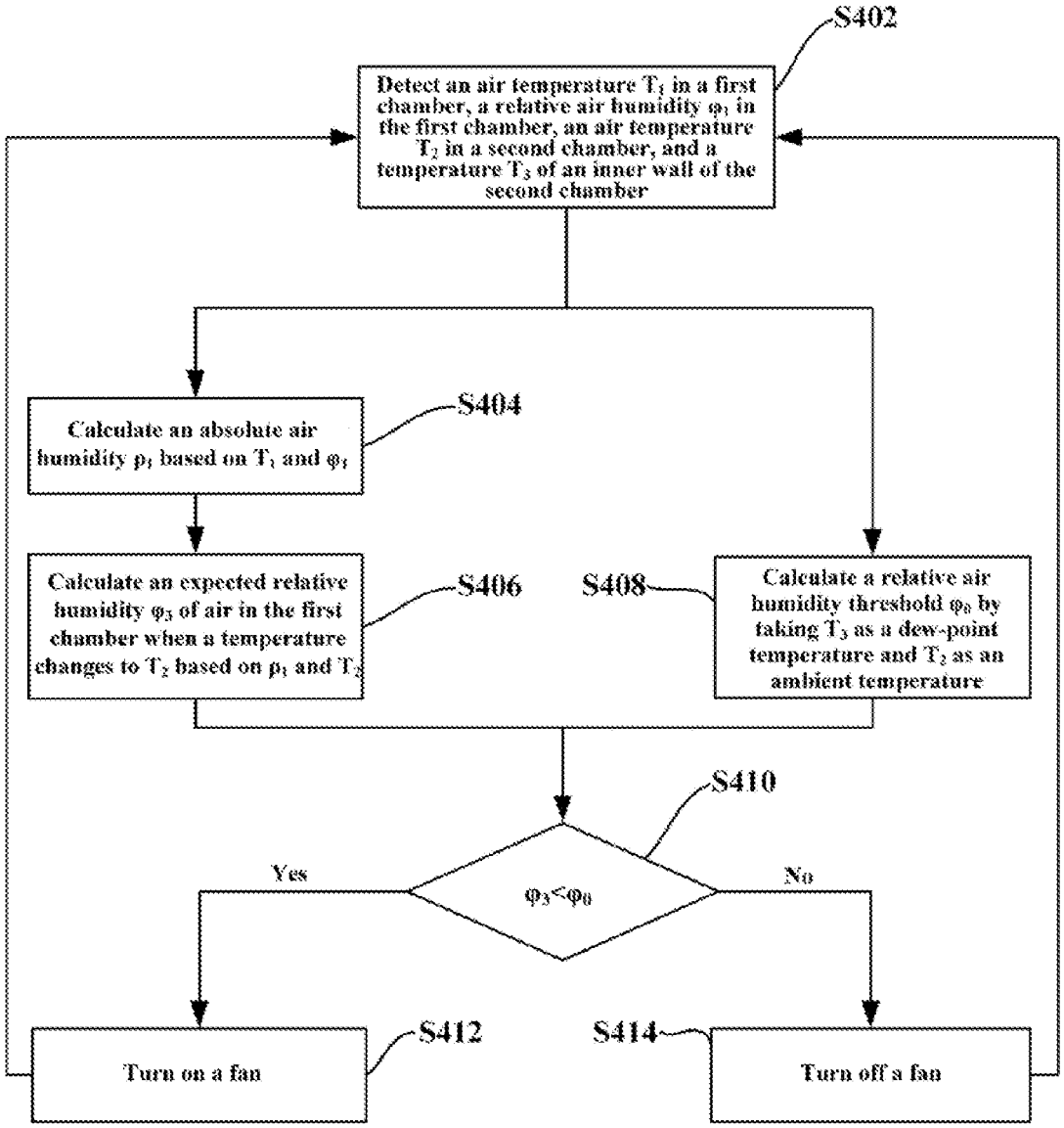
FIG. 4 is a flowchart of a control method for a refrigerator according to an embodiment of the present invention.

FIG. 4 is a flowchart of a control method for a refrigerator according to an embodiment of the present invention. As shown in FIG. 4, the control method for a refrigerator may include the following steps:

Step S402: detecting an air temperature $T_1$ in the first chamber 101, a relative air humidity $\varphi_1$ in the first chamber 101, an air temperature $T_2$ in the second chamber 201, and an air temperature $T_3$ of the inner wall of the second chamber 201.

In this step, as shown in FIG. 1 and FIG. 2, a first temperature sensor 300 may be configured to detect the air temperature $T_1$ in the first chamber 101; a relative humidity sensor 400 is configured to detect the relative air humidity $\varphi_1$ in the first chamber 101; a second temperature sensor 500 is configured to detect the air temperature $T_2$ in the second chamber 201; and a third temperature sensor 600 is configured to detect the air temperature $T_3$ of the inner wall of the second chamber 201. The first temperature sensor 300, the relative humidity sensor 400, the second temperature sensor 500 and the third temperature sensor 600 are all connected to the controller 700, so as to transmit detection signals to the controller 700.

In this step, a temperature of the rear wall 211 of the second chamber 201 is detected, and is taken as the temperature $T_3$ of the inner wall. The inventors have realized that the rear wall 211 of the second chamber 201 is close to the first chamber 101, and can transfer heat with the air in the first chamber 101 through heat conduction; therefore, the temperature of the rear wall 211 is lower than those at other wall surfaces of the second chamber 201, and it is easier to produce condensation. As long as no condensation is produced on the rear wall 211, it can be basically guaranteed that no condensation is produced on the other wall surfaces. Therefore, in this embodiment, only the temperature of the rear wall is detected, thereby better avoiding condensation.

Step S404: calculating an absolute air humidity $\rho_1$ in the first chamber 101 based on the air temperature $T_1$ in the first chamber 101 and the relative air humidity $\varphi_1$ in the first chamber 101. A specific calculation manner for calculating an absolute humidity based on an air temperature and a relative humidity is known by all persons skilled in the art, and belongs to basic knowledge commonly used in the field of refrigeration. Specifically, the absolute humidity can be calculated according to a formula or obtained by querying in a table, which does not need to be described in detail herein.

Step S406: calculating an expected relative humidity $\varphi_3$ of the air in the first chamber 101 when the temperature changes to $T_2$ based on the absolute air humidity $\rho_1$ and the air temperature $T_2$.

Step S408: calculating a relative air humidity threshold $\varphi_0$ based on a correspondence relationship of a dew-point temperature, an ambient temperature and a relative humidity by taking the temperature $T_3$ of the inner wall of the second chamber 201 as the dew-point temperature and the air temperature $T_2$ as the ambient temperature. Specifically, the "correspondence relationship of a dew-point temperature, an ambient temperature and a relative humidity" is known by all persons skilled in the art, belongs to basic knowledge commonly used in the field of refrigeration, and specifically includes a computational formula and a relationship table, which do not need to be described in detail herein. Step S404 and step S408 are both steps after step S402, but this embodiment does not limit an implementation sequence from step S404 to step S408.

Step S410: determining whether $\varphi_3<\varphi_0$ is valid. If $\varphi_3<\varphi_0$ is valid, step S412 is implemented; otherwise, step S414 is implemented.

Step S412: turning on the fan 230. A purpose for turning on the fan 230 is to enable the air supply port 212 to supply air to the second chamber 201.

Step S414: turning off the fan 230. A purpose for turning off the fan 230 is to enable the air supply port 212 to stop supplying air to the second chamber 201.

The above steps in this embodiment are cyclically implemented. That is, after step S412 and step S414 are implemented, step S402 is implemented again to form a cycle. In this way, an open/close state of the air supply port 212 can be adjusted as soon as possible according to temperature and humidity changes of the first chamber 101 and the second chamber 201.

In the above steps, preferably, a distance from a temperature detection point on the rear wall of the second chamber 201 to the air supply port 212 is shorter than or equal to a first preset distance, that is, a distance from the second temperature sensor 500 to the air supply port 212 (namely a lower edge closest to the air supply port 212) is shorter than or equal to the first preset distance. Preferably, a distance from a detection point of the air temperature $T_2$ to the air supply port 212 is shorter than or equal to a second preset distance, that is, a distance from the third temperature sensor 600 to the air supply port 212 is shorter than or equal to the second preset distance. Preferably, distances from a detection point of the air temperature $T_1$ and a detection point of the relative air humidity $\varphi_1$ to the air supply port 212 are shorter than or equal to a third preset distance, that is, the distances from the first temperature sensor 300 and the relative humidity sensor 400 to the air supply port 212 are shorter than or equal to the third preset distance. The first preset distance, the second preset distance and the third preset distance may be the same value or different values ranging from 10 cm to 20 cm. In this embodiment, the distances from the detection point of the air temperature $T_1$ in the first chamber 101, the detection point of the relative air humidity $\varphi_1$ in the first chamber 101, the temperature detection point on the rear wall of the second chamber 201, and the detection point of the air temperature $T_2$ of the second chamber 201 to the air supply port 212 are limited to make sure that the above detection points are closer to the air supply port 212, so that temperature and humidity detection is specially performed on an air flow that first enters the air supply port 212 in a later period, thereby achieving more accurate prediction on whether condensation will be produced after the air flow in the first chamber 101 flows into the second chamber 201.

In conclusion, it should be learned by those skilled in the art that although various exemplary embodiments of the present invention have been illustrated and described in detail herein, many other variations or modifications consistent with the principles of the present invention may be directly determined or derived from the disclosure of the present invention without departing from the spirit and scope of the present invention. Therefore, the scope of the present invention should be construed and considered as covering all these other variations or modifications.

What is claimed is:

1. A control method for a refrigerator, wherein the refrigerator comprises a refrigerator body having a front side opened to define a first chamber, and a door body configured to open or close the first chamber; the door body comprises a main door and a secondary door; the main door is configured to open or close the first chamber and defines a second chamber; the secondary door is configured to open or close the second chamber; a rear side of the main door is provided with an air supply port configured to introduce cold air in the first chamber into the second chamber; the refrigerator further comprises a controller comprising a processor for executing the control method; and the control method comprises:

acquiring an absolute air humidity $\rho_1$ of the first chamber and an air temperature $T_2$ of the second chamber detected by a second temperature sensor;

calculating an expected relative humidity $\varphi_3$ of air in the first chamber when the temperature changes to $T_2$ based on the absolute air humidity pi and the air temperature $T_2$;

determining a relative air humidity threshold $\varphi_0$ at which air in the second chamber begins to condense on an inner wall of the second chamber;

comparing the expected relative humidity $\varphi_3$ with the relative air humidity threshold $\varphi_0$; and if $\varphi_3<\varphi_0$, enabling the air supply port to supply air to the second chamber, otherwise enabling the air supply port to stop supplying air to the second chamber.

2. The control method according to claim 1, further comprising:

acquiring a temperature $T_3$ of the inner wall of the second chamber detected by a third temperature sensor; and calculating the relative air humidity threshold $\varphi_0$ based on a correspondence relationship of a dew-point temperature, an ambient temperature and a relative humidity by taking the temperature $T_3$ of the inner wall as the dew-point temperature and the air temperature $T_2$ as the ambient temperature.

3. The control method according to claim 2, wherein the step of acquiring a temperature $T_3$ of the inner wall of the second chamber comprises:

detecting a temperature of a rear wall of the second chamber, and taking the temperature as the temperature $T_3$ of the inner wall.

4. The control method according to claim 3, wherein a distance from a temperature detection point on the rear wall of the second chamber to the air supply port is shorter than or equal to a first preset distance.

5. The control method according to claim 2, wherein a distance from a detection point of the air temperature $T_2$ to the air supply port is shorter than or equal to a second preset distance.

6. The control method according to claim 1, further comprising:

detecting an air temperature $T_1$ in the first chamber by a first temperature sensor and a relative air humidity $\varphi_1$ in the first chamber by a relative humidity sensor; and calculating the absolute air humidity $\rho_1$ based on the air temperature $T_1$ and the relative air humidity $\varphi_1$.

7. The control method according to claim 6, wherein distances from a detection point of the air temperature $T_1$ and a detection point of the relative air humidity $\varphi_1$ to the air supply port are shorter than or equal to a third preset distance.

8. The control method according to claim 1, wherein a fan is mounted at the air supply port; and in the control method, the step of if $\varphi_3<\varphi_0$, enabling the air supply port to supply air to the second chamber, otherwise enabling the air supply port to stop supplying air to the second chamber comprises:

if $\varphi_3<\varphi_0$, turning on the fan to enable the air supply port to supply air to the second chamber; otherwise, turning off the fan to enable the air supply port to stop supplying air to the second chamber.

9. A refrigerator, comprising:

a refrigerator body, having a front side opened to define a first chamber;

a door body, comprising a main door and a secondary door, wherein the main door is configured to open or close the first chamber and defines a second chamber, the secondary door is configured to open or close the second chamber, and a rear side of the main door is provided with an air supply port configured to introduce cold air in the first chamber into the second chamber; and a controller, comprising a processor and a memory, wherein the memory stores a computer program, and the processor is configured to:

when the computer program is executed by the processor, acquire an absolute air humidity $\rho_1$ of the first chamber and an air temperature $T_2$ of the second chamber;

calculate an expected relative humidity $\varphi_3$ of air in the first chamber when the temperature changes to $T_2$ based on the absolute air humidity pi and the air temperature $T_2$;

determine a relative air humidity threshold $\varphi_0$ at which air in the second chamber begins to condense on an inner wall of the second chamber;

compare the expected relative humidity $\varphi_3$ with the relative air humidity threshold $\varphi_0$; and if $\varphi_3<\varphi_0$, enable the air supply port to supply air to the second chamber, otherwise enable the air supply port to stop supplying air to the second chamber.

10. The refrigerator according to claim 9, wherein the first chamber is a refrigeration chamber; and the air supply port is disposed at the top of the rear side of the main door, and the bottom of the rear side of the main door is further provided with an air return port for enabling air in the second chamber to flow to the first chamber.

* * * * *